US006152724A

United States Patent [19]

Becker

[11] Patent Number: 6,152,724

[45] Date of Patent: Nov. 28, 2000

[54] DEVICE FOR AND METHOD OF BURNING A FUEL IN AIR

[75] Inventor: Bernard Becker, Mülheim an der Ruhr, Germany

[73] Assignee: Siemens Aktiengesellschaft, Munich, Germany

[21] Appl. No.: 09/265,443

[22] Filed: Mar. 9, 1999

Related U.S. Application Data

[63] Continuation of application No. PCT/DE97/01852, Aug. 26, 1997.

[30] Foreign Application Priority Data

Sep. 9, 1996 [DE] Germany ..... 196 36 556
Oct. 2, 1996 [DE] Germany ..... 196 40 818

[51] Int. Cl.[7] ..... F23D 14/24

[52] U.S. Cl. ..... 431/9; 239/402; 239/405

[58] Field of Search ..... 431/9, 8, 114, 431/181, 185; 60/737, 749; 239/402, 406, 405, 433, 463

[56] References Cited

U.S. PATENT DOCUMENTS

| | | | |
|---|---|---|---|
| 5,251,447 | 10/1993 | Joshi et al. | 431/185 |
| 5,345,768 | 9/1994 | Washam et al. . | |
| 5,435,126 | 7/1995 | Beaudoin | 60/737 |
| 5,471,840 | 12/1995 | Lovett | 60/749 |
| 5,487,274 | 1/1996 | Gulati et al. | 60/737 |
| 5,638,682 | 6/1997 | Joshi et al. | 60/737 |

FOREIGN PATENT DOCUMENTS

| | | |
|---|---|---|
| 0 193 838 A2 | 9/1986 | European Pat. Off. . |
| 0 193 838 A3 | 9/1986 | European Pat. Off. . |
| 0 193 838 B1 | 9/1986 | European Pat. Off. . |
| 0 589 520 B1 | 3/1994 | European Pat. Off. . |
| 1 215 443 | 4/1966 | Germany . |
| 42 12 810 A1 | 10/1992 | Germany . |
| 43 29 971 A1 | 3/1995 | Germany . |
| 44 15 916 A1 | 11/1995 | Germany . |

OTHER PUBLICATIONS

International Publication No. WO 97/11311 (Prade et al.), dated Mar. 27, 1997, burner, in particular for a gas turbine.

International Publication No. WO 92/19913 (Becker), dated Nov. 12, 1992.

*Primary Examiner*—Ira S. Lazarus
*Assistant Examiner*—Sara Clarke
*Attorney, Agent, or Firm*—Herbert L. Lerner; Laurence A. Greenberg; Werner H. Stemer

[57] ABSTRACT

A device and a method for burning fuel in air. The device includes an annular passage for directing the air in a meridional flow with regard to an axis. A swirl cascade is provided for imposing a swirl on the flow, and a mixer for intermixing the fuel with the flow for forming an essentially homogeneous mixture. Also present is an air flow delayer for delaying a portion of the flow that lies radially on the outside with regard to the axis relative to other portions of the flow. The device is configured in particular as a premix burner, for example for use in a gas-turbine plant.

11 Claims, 4 Drawing Sheets

DEVICE FOR AND METHOD OF BURNING A FUEL IN AIR

CROSS-REFERENCE TO RELATED APPLICATION

This application is a continuation of copending International Application No. PCT/DE97/01852, filed on Aug. 26, 1997, which designated the United States.

BACKGROUND OF THE INVENTION

FIELD OF THE INVENTION

The invention relates to a device for burning a fuel in air. The device includes an annular passage for directing the air in a meridional flow with regard to an axis; a swirl cascade for imposing a swirl on the flow; and a mixer for intermixing the fuel with the flow forming an essentially homogeneous mixture.

In addition, the invention relates to a method of burning the fuel in air, in which the air is provided in a flow encircling an axis and continuing meridionally with regard to the axis and with a swirl is essentially mixed homogeneously with fuel for forming a mixture, which is ignited in order to burn the fuel.

Such a device, under the designation "premix burner", is known to persons skilled and active in the relevant art, the designation already pointing to the fact that the fuel is burned only with a certain time interval after its intermixing with the air provided for the combustion. The method is also known to the persons skilled and active in the relevant art as the method that takes place during the operation of a conventional premix burner.

During the operation of a conventional premix burner, when the feeding of fuel to the burner is increased, a state is often reached in which the combustion becomes unstable and acoustic vibrations are caused in the plant into which it is fitted. The acoustic vibrations are known by the term "combustion vibrations". The combustion vibrations may be so great that they jeopardize the operation of the premix burner and the plant, of which the premix burner is an integral part. The tendency of a premix burner to form unstable combustion becomes all the greater, the more homogenous the mixture of fuel is and the air formed in the premix burner before the combustion. However, a mixture which is as homogeneous as possible is desired in view of the fact that the production of nitrous oxides during the combustion is lower, the more homogenous is the mixture. If the mixture is completely homogenous, the maximum temperature occurring during the combustion of the mixture assumes a minimum, and it is precisely this effect which is essential for an especially low production of nitrous oxides.

European Patents EP 0 193 838 B1 and EP 0 589 520 E1 also disclose such a device and method.

To stabilize the combustion of a premix burner, it has been proposed to envelope the igniting mixture flowing from the burner with a veil of air and thus prevent vortices from forming in marginal regions of the mixture, in which vortices combustion processes take place, from which it may be assumed that they contribute substantially to the destabilization of the combustion. However, a disadvantage of the proposed measure may be seen in the fact that the air which is used to envelope the mixture has to be extracted from the actual combustion operation. If the thermal output to be released by the premix burner is fixed, the quantity of fuel to be used is also essentially fixed, and a withdrawal of air for stabilizing the combustion results in the actual combustion taking place in the presence of a reduced quantity of air and, in view of the fact that the combustion, in particular in a gas-turbine plant, is effected as a rule with excess air, must proceed with a markedly increased maximum temperature and thus with a markedly increased formation of nitrous oxides.

SUMMARY OF THE INVENTION

It is accordingly an object of the invention to provide a device for and a method of burning a fuel in air that overcome the above-mentioned disadvantages of the prior art devices and methods of this general type, in which a measure for stabilizing the combustion process in a premix burner is specified, and in which measure it is not necessary to extract a portion of the available air from the combustion process.

With the foregoing and other objects in view there is provided, in accordance with the invention, a device for burning a fuel in air, including: a body having an axis and an annular passage formed therein for directing air in a meridional flow with regard to the axis; a swirl cascade connected to the body and imposing a swirl on the flow; an air flow delayer connected to the body and delaying a portion of the flow lying radially on an outside with regard to the axis relative to other portions of the flow; and a mixer connected to the body and intermixing fuel with the flow for forming a substantially homogeneous air/fuel mixture.

According to the invention, the distribution of the velocity in the flow, when the latter discharges from the device, is configured non-uniformly in the radial direction with regard to the axis, but at the same time the homogeneity of the mixture of air and fuel in the flow is retained. In this case, the non-uniformity in the distribution of the velocity in the flow may relate to the meridional component of the velocity, the tangential component of the velocity or both components of the velocity. This is effected by the flow being locally disturbed in the annular passage by an appropriate obstacle in the form of a screen or the like, which is disposed at an appropriate point in the annular passage.

Whether the premix burner embodied as such a device in the individual case requires stabilization by a so-called pilot flame, as known from the prior art cited, and whether this pilot flame is disposed in the center or at the outer periphery of the flow, or whether the premix burner needs a pilot flame at all, is of secondary importance here. The same applies to the configuration of the swirl cascade; this may be an axial, radial or diagonal swirl cascade in accordance with the requirements of the respective individual case. Details for the feeding of the fuel are also of secondary importance here; in principle, the fuel may be fed in any manner, for example via nozzles in guide blades of the swirl cascade or separate mixing devices in front of or behind the swirl cascade.

The air flow delayer for delaying the portion of the flow which lies radially on the outside with regard to the axis relative to other portions of the flow produces a local pressure loss in the flow which causes a lower flow velocity to prevail behind the air flow delayer than in the portions of the flow unaffected by the air flow delayer. It goes without saying that the mixer for intermixing the fuel with the flow must be configured for the requisite homogeneity of the mixture produced. It may be necessary to correspondingly reduce the feed of fuel to the delayed portion of the flow compared with the feed to the other portions of the flow.

The non-uniform distribution of the velocity in the flow ensures that the mixture does not ignite simultaneously at all points of the flow. The expansion caused in the mixture by the combustion is therefore not effected abruptly but in a distributed manner over a certain time interval. The tendency towards instability is thereby, substantially reduced.

In addition, since the flow is slower in its outer region than in its inner region, the tendency to form vortices is reduced, which likewise substantially helps to stabilize the combustion. However, an increase in the maximum temperature during the combustion does not occur, since all the available air is utilized to burn the fuel.

A first especially preferred development of the device is distinguished by the fact that the air flow delayer provided for delaying a portion of the flow which lies radially on the outside with regard to the axis is circular-symmetrical with regard to the axis, so that the portion of the flow delayed by the air flow delayer is likewise circular-symmetrical with regard to the axis. The entire flow is thus enveloped by a portion which is markedly slowed down relative to other portions. This slowed-down portion is therefore decisive for the aerodynamic relationships at a boundary surface between the flow discharging from the device and the air free of fuel, which, on account of a reduced velocity gradient caused by the delay, leads to suppression of the formation of vortices and thus to the acoustic stabilization of combustion effected in the flow.

The circular-symmetrical air flow delayer is preferably a choke ring disposed in the annular passage and extending over a part of the annular passage which lies radially on the outside with regard to the axis, which choke ring is in particular disposed upstream of the swirl cascade. Furthermore, the choke ring is preferably formed from choke elements, in particular bars, disposed in the annular passage and uniformly distributed about the axis. The choke ring is not intended to completely cover the part of the annular passage over which it extends but is merely intended to choke the flow through this part. The choke ring will therefore always be configured functionally like a screen.

A development of the device especially preferred as an alternative is distinguished by the fact that the air flow delayer is constructed to be discontinuously symmetrical, in particular discretely symmetrical, with regard to the axis. In this case, a discontinuously symmetrical configuration defines a configuration which is substantially different from a circular-symmetrical configuration and is distinguished in particular by the fact that it has no (continuous) circular symmetry but if need be has discrete symmetry, e.g. described by a finite symmetry group. This discontinuously symmetrical air flow delayer therefore does not lead to the flow being enveloped by the portion delayed as a body and uniformly, as results in the case of the first especially preferred development described above. In contrast, the flow in an outerlying region has streaks that are delayed relative to other portions of the flow. The slow streaks are likewise suitable for preventing the formation of vortices, which could envelop the flow after it is discharged from the device. This is because the slow streaks form local disturbances in the velocity zone of the flow, which counteract the formation of vortices and can thus lead to the desired acoustic stabilization of a flame produced in the flow, as already described.

The discontinuously symmetrical air flow delayer is preferably a configuration of choke elements, in particular bars, distributed non-uniformly about the axis.

The mixer for intermixing the fuel is preferably a configuration of nozzles, in which case the nozzles may be disposed in the swirl cascade, in particular in such a way that the nozzles are located in guide blades of the swirl cascade.

With regard to the method, the object is achieved according to the invention by a method of burning the fuel in air, in which the air is provided in a flow encircling an axis and continuing meridionally with regard to the axis and with a swirl is essentially mixed homogeneously with fuel for forming a mixture. The mixture is ignited in order to burn the fuel, a portion of the flow which lies radially on the outside with regard to the axis is delayed relative to other portions of the flow before the ignition.

The advantages of the method may be deduced from the explanations relating to the device according to the invention and its configurations, to which reference is hereby made.

The delay in the portion of the flow that lies radially on the outside may be effected in a circular-symmetrical manner with regard to the axis; alternatively, it is possible to carry out the delay in a discontinuously symmetrical manner with regard to the axis. Details thereof follow from the above explanations relating to the two especially preferred developments of the device according to the invention, to which reference is hereby made.

Other features which are considered as characteristic for the invention are set forth in the appended claims.

Although the invention is illustrated and described herein as embodied in a device for and a method of burning a fuel in air, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
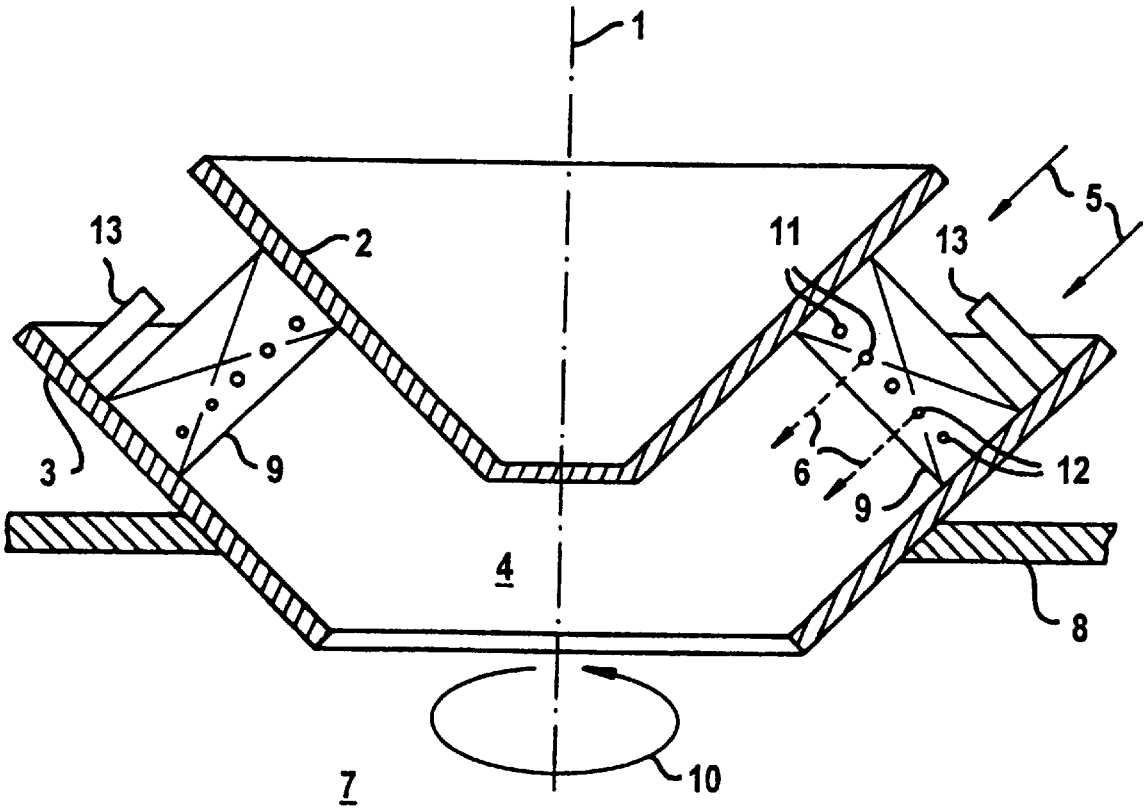
FIG. 1 is a perspective, longitudinal sectional view through an embodiment of a premix burner according to the invention.

In the figures of the drawing, components corresponding to one another of the respectively shown exemplary embodiments in each case have the same reference numeral.

The drawing is not to be considered as a representation of exemplary embodiments actually realized and is simplified in order to emphasize certain features. The information which can be gathered directly from the drawing can be supplemented for the practical construction within the limits of the knowledge and capability at the disposal of the persons skilled and active in the relevant art with due regard to the explanations preceding this information.

Figure 2:
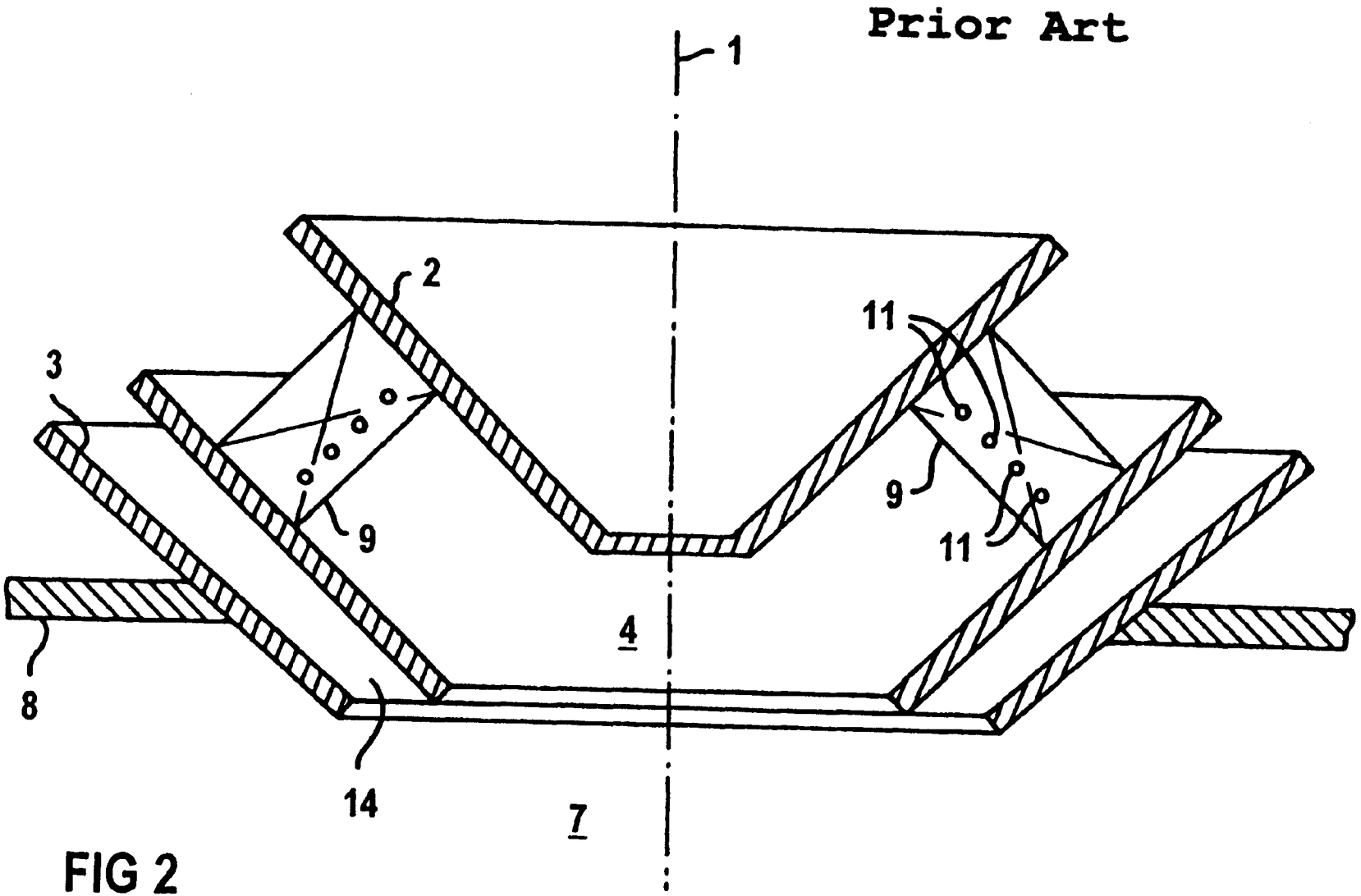
FIG. 2 is a perspective, longitudinal sectional view through the premix burner of the prior art.

Referring now to the figures of the drawing in detail and first, particularly, to FIG. 1 thereof, there is shown an exemplary embodiment of the device according to the invention, and FIG. 2 shows for the purposes of comparison an embodiment within the scope of the proposal dealt with in the introduction according to the prior art. Many components are present in both embodiments, and to explain the components reference is first of all jointly made to FIGS. 1 and 2.

FIGS. 1 and 2 each show a premix burner having an axis 1, an inner body 2 disposed centrically with regard to the axis 1, and an outer body 3 likewise disposed centrically with regard to the axis 1 and surrounding the inner body 2. An annular passage 4 through which a flow 5 of air is directed lies between the inner body 2 and the outer body 3. In the annular passage 4, the air is mixed with fuel 6 to form a mixture, which flows into a combustion space 7 and burns there. An ignition device for igniting the mixture is not shown for the sake of clarity. Within the limits of conventional practice, which prefers a plurality of premix burners for a combustion space 7, an ignition device is not required for each burner, but a single ignition device suffices for all burners. In this sense, an ignition device is therefore not an integral part of an individual premix burner, for which reason the omission of an ignition device from the figures is also justified. The premix burner is let into a combustion space wall 8, which closes off the combustion space 7 upstream of the flow 5. Disposed in the annular passage 4 is a swirl cascade 9 consisting of guide blades 9, which serves to impose a swirl 10 on the flow 5. Nozzles 11 and 12 are provided in the guide blades 9 in order to feed the fuel 6 to the flow 5. The device for feeding the fuel 6 to the nozzles 11 and 12 are not shown for the sake of clarity. A pilot burner, which may possibly be useful or necessary for operating the premix burner and delivers a special flame that helps to stabilize the combustion of the mixture of air and fuel, is also not shown. Such a pilot burner may be necessary if the premix burner is to be operated under fluctuating mixture ratios of air and fuel, since a comparatively lean mixture may possibly no longer ignite in a reliable manner without assistance. As already explained, whether to use or not to use a pilot burner is at the discretion of the persons skilled and active in the relevant art.

An exemplary embodiment of the invention is shown in FIG. 1. Within the scope of the exemplary embodiment, a choke ring 13 consisting of individual bars attached to the outer body 3 and projecting into the annular passage 4 is provided in front of the swirl cascade 9. The bars cause local pressure losses in the flow 5 and lead to the outer portion of the flow 5, which passes close to the outer body 3, being slowed down or delayed relative to other portions of the flow 5. The slowing down continues through the entire annular passage 4 and leads to a non-uniform distribution of the velocity in the mixture, which flows off into the combustion space 7. This results in the stabilizing effects, already described at the beginning, on the combustion taking place in the combustion chamber 7, to the above explanation of which reference is hereby made. The feeding of the fuel 6 to the flow 5 must take into account the non-uniform distribution of the velocity in the flow 5. Therefore, large nozzles 11 are provided for feeding the fuel to the largely unaffected portion of the flow and small nozzles 12 are provided for feeding the fuel 6 to the slowed-down portion of the flow 5. The dimensions of the nozzles 11 and 12 are to be selected in such a way that a largely homogeneous distribution of the fuel in the flow is achieved and thus combustion having as low a production of nitrous oxide as possible is ensured. For appropriate construction of the device, computer programs for the numerical modeling of the flow 5 are available to the persons skilled and active in the relevant art, the utilization of which computer programs permits an appropriate configuration of the nozzles 11 and 12.

FIG. 2 shows a device in which the annular passage 4 is free of built-in choking components. Accordingly, nozzles of different size are also not required for feeding the fuel 6; only large nozzles 11 are provided. In order to stabilize the combustion which can be produced with this device, an annular nozzle 14 surrounding the outer body 3 is provided, from which a portion of the air fed to the device is directed past the annular passage 4 and the swirl cascade 9 directly into the combustion chamber 7. The air forms a veil which envelops the mixture of air and fuel and prevents the formation of vortices, which could make the combustion unstable. A disadvantage in the prior art embodiment according to FIG. 2 is the requirement that a portion of the available air is not available for the mixing with fuel. Therefore, the device produces nitrous oxides to an increased degree, which is always undesirable.

Figure 3:
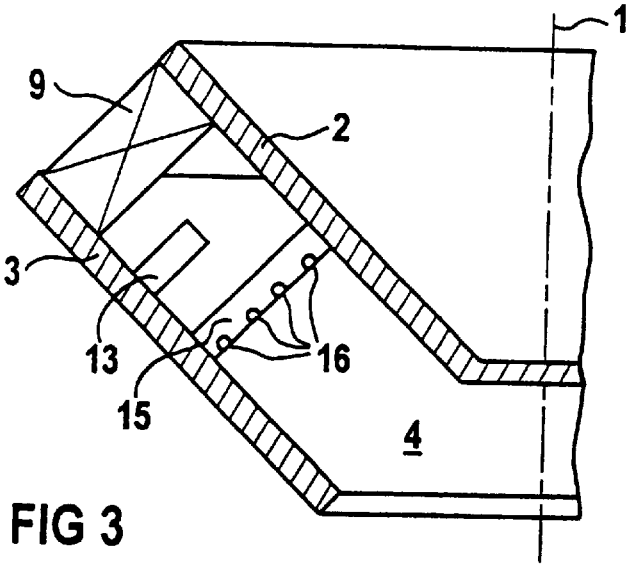
FIG. 3 is a fragmentary, perspective sectional view of a second embodiment of the premix burner according to the invention.

FIG. 3 shows a partial view of the axial longitudinal section through a variant of the device according to FIG. 1. Many components of this device correspond to the components of the device according to FIG. 1 and therefore do not need to be described again. Of importance in FIG. 3 is the fact that the guide blades 9 are no longer used to feed the fuel 6 but that separate nozzle tubes 15 are provided for this purpose, which nozzle tubes 15 have nozzles 16 for feeding the fuel 6 to the flow 5. The device for feeding the fuel to the nozzle tubes 15 are again not shown for the sake of clarity. The nozzles 16 need not all be the same size as one another. To this end, see the explanations relating to the nozzles 11 and 12 in FIG. 1.

Figure 4:
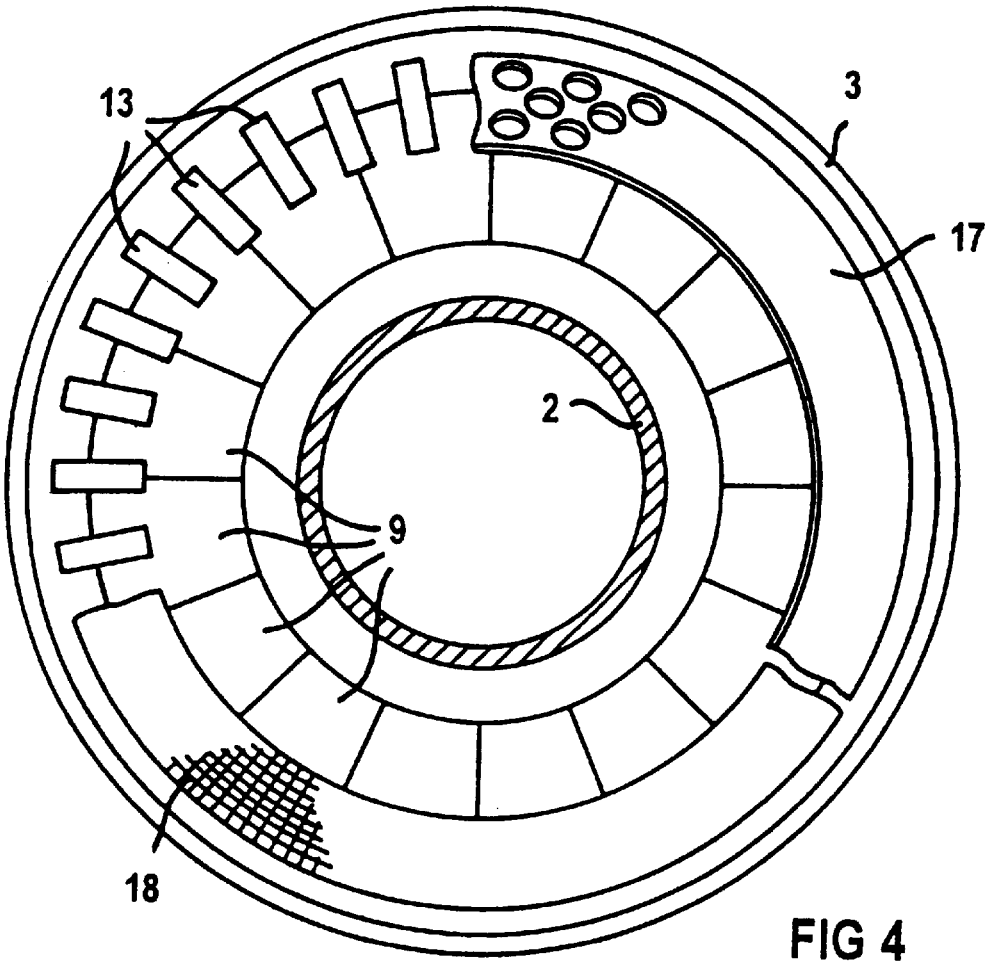
FIG. 4 is a partially broken away sectional view of a third embodiment of the premix burner.

FIG. 4 shows a cross-section through a preferred further development, in which a plurality of alternatives for delaying a portion of the flow can be seen. In addition to the bars 13 already mentioned, there is a perforated plate 17 as well as a fabric 18 consisting of wire or the like (the actual fabric only being partly shown). The guide blades 9, which extend between the inner body 2 and the outer body 3, are visible behind the devices 13, 17 and 18. In the exemplary embodiment according to FIG. 4, it is of importance that the delay in the portion of the flow 5 which lies radially on the outside (see FIG. 1 in this respect) is effected in a circular-symmetrical manner with regard to the axis 1. The flow released from the device according to FIG. 4 therefore has a radially outerlying portion which is uniformly delayed relative to other portions of the flow 5. The effects that can thereby be achieved have already been explained in detail above, to which reference is hereby made.

It may be noted in respect of FIG. 4 that the delaying device shown, in particular the bars 13, do not of course form a configuration that is circular-symmetrical in the strictest mathematical sense, that is, has a continuous symmetry group. However, it is to be taken into consideration that each of the bars 13 produces certain local disturbances, in particular turbulence, in the flow 5, which have subsided, however, behind the respective bar 13 within a distance which is rather short. On the other side of a certain distance behind the configuration of the bars 13, the flow 5 homogenizes again and only retains properties that are effectively distributed in a circular-symmetrical manner relative to the axis 1. If the invention is actually realized in the sense of the exemplary embodiment according to FIG. 4 with bars 13, in which case corresponding considerations apply of course to the perforated plates 17 and screens 18, the number and geometry of the bars 13 is therefore to be selected with reference to the aerodynamic factors of the device to be realized. Appropriate knowledge and devices are at the disposal of the persons skilled and active in the relevant art.

Figure 5:
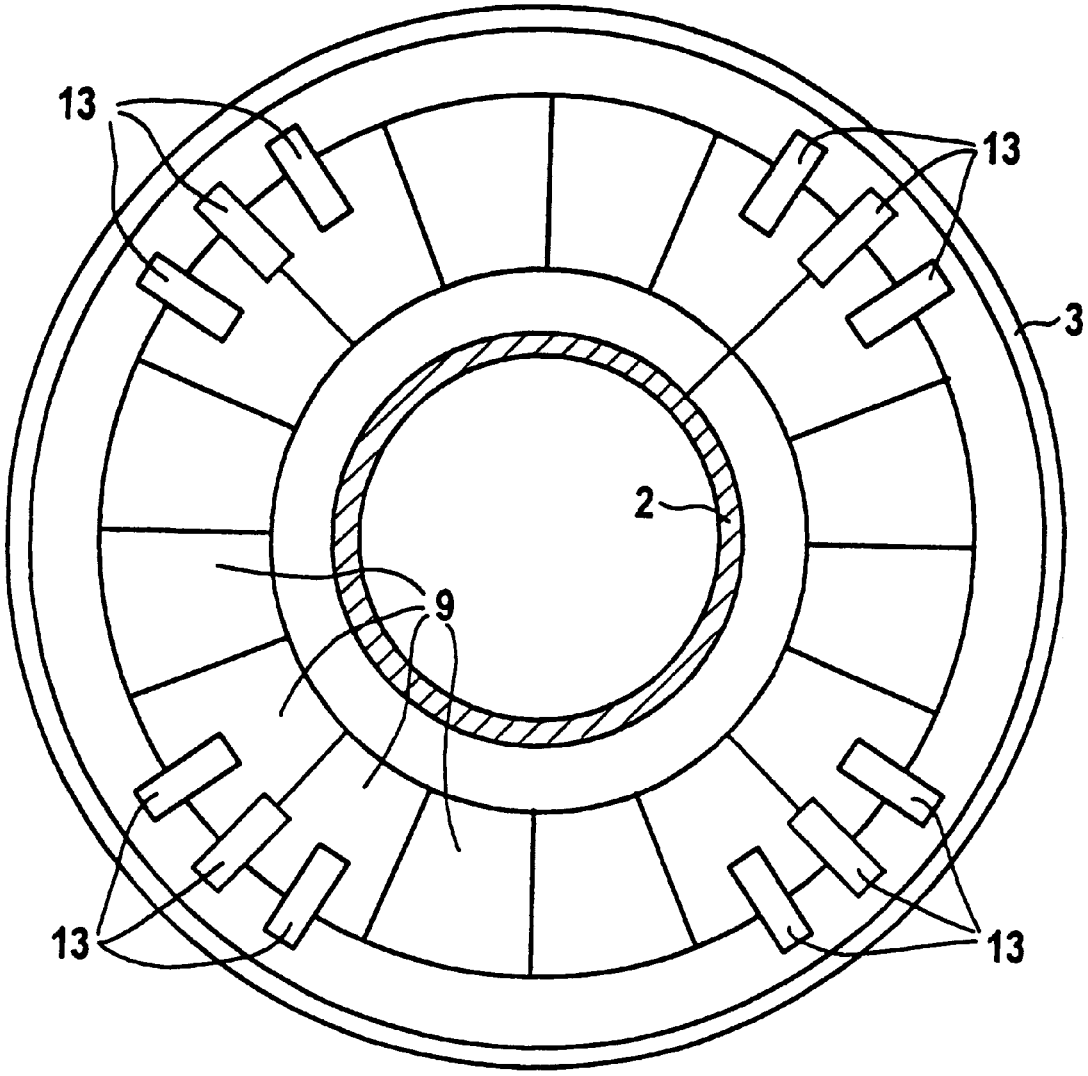
FIG. 5 is a sectional view of a fourth embodiment of the premix burner.

FIG. 5 shows a cross-section through another preferred development, in which the delaying device, in contrast to the exemplary embodiment according to FIG. 4, is not constructed in a circular-symmetrical manner with regard to the axis 1 but in a discontinuously symmetrical manner. In the exemplary embodiment according to FIG. 5, the symmetry is discontinuous to such an extent that a discrete, namely fourfold, symmetry is present. The configuration of the bars 13 according to FIG. 5 is conceived in such a way that it produces irregularities in the flow 5, which continue until well behind the bars 13 and the swirl cascade 9 and are still present even after the discharge from the device. After discharge from the device, there is accordingly an effectively non-uniform velocity zone in the flow 5, which velocity zone likewise suppresses the formation of vortices, which could surround the flow 5, and can therefore be used for the desired acoustic stabilization of a flame produced in the flow 5.

All the embodiments of the invention are of particular importance for use in a gas turbine in order to heat a compressed air flow there, provided by a compressor, by burning a fuel, whereupon the heated flow is expanded in a turbine. The invention is distinguished in particular by the fact that, on the one hand, it provides merely passive measures for the stabilization of combustion and, on the other hand, it requires no branching of air from the air which is otherwise available for the combustion.

I claim:

1. A device for burning a fuel in air, comprising:

a body having an axis and an annular passage formed therein for directing air in a meridional flow with regard to said axis;

a swirl cascade connected to said body and imposing a swirl on the meridional flow;

an air flow delayer connected to said body and delaying a portion of the meridional flow lying radially on an outside with regard to said axis relative to other portions of the meridional flow, said air flow delayer for delaying the portion of the meridional flow and lying radially on the outside with regard to said axis is disposed circular-symmetrical with regard to said axis, said air flow delayer being a choke ring disposed in said annular passage and extending over a part of said annular passage lying radially on the outside with regard to said axis, said choke ring being disposed upstream of said swirl cascade; and a mixer connected to said body and intermixing fuel with the meridional flow for forming a substantially homogeneous air/fuel mixture.

2. The device according to claim 1, wherein said choke ring has uniformly distributed choke elements.

3. The device according to claim 1, wherein said choke ring is formed from bars disposed on said body and extending into said annular passage.

4. The device according to claim 1, wherein said air flow delayer is disposed discontinuously symmetrical with regard to said axis.

5. The device according to claim 4, wherein said air flow delayer is formed from choke elements distributed non-uniformly about said axis.

6. The device according to claim 4, wherein said air flow delayer is formed of bars distributed non-uniformly about said axis.

7. The device according to claim 1, wherein said air flow delayer is disposed discretely symmetrical with regard to said axis.

8. The device according to claim 1, wherein said mixer includes a configuration of nozzles.

9. The device according to claim 8, wherein said nozzles are formed in said swirl cascade.

10. The device according to claim 8, wherein said swirl cascade has guide blades and said nozzles are formed in said guide blades.

11. A method of burning a fuel in air, which comprises:

forming an air flow encircling an axis and continuing meridionally with regard to the axis;

delaying a portion of the air flow lying radially on an outside in a discontinuously symmetrical pattern with regard to the axis relative to other portions of the air flow;

introducing fuel into the air flow;

swirling the air flow with the fuel for forming a substantially homogeneous fuel/air mixture; and igniting and burning the fuel/air mixture.

* * * * *